US007203972B2

(12) United States Patent
Pietrzak et al.

(10) Patent No.: US 7,203,972 B2
(45) Date of Patent: Apr. 17, 2007

(54) STRAP ADJUSTMENT ASSEMBLY

(75) Inventors: Christopher T. Pietrzak, Park City, UT (US); Christopher J. Bullock, Campbell, CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 0 days.

(21) Appl. No.: 11/021,336

(22) Filed: Dec. 22, 2004

(65) Prior Publication Data

US 2005/0241050 A1 Nov. 3, 2005

Related U.S. Application Data

(60) Provisional application No. 60/567,356, filed on Apr. 30, 2004.

(51) Int. Cl.
*A42B 7/00* (2006.01)

(52) U.S. Cl. ..... 2/421; 24/170; 24/191

(58) Field of Classification Search ..... 2/421, 2/417, 418, 419, 425, 183; 24/170, 191
See application file for complete search history.

(56) References Cited

U.S. PATENT DOCUMENTS

| | | | | | |
|---|---|---|---|---|---|
| 44,786 | A | * | 10/1864 | Cowles | 24/170 |
| 1,079,080 | A | | 11/1913 | Ward | |
| 2,271,132 | A | | 1/1942 | Thoresen | |
| 2,363,872 | A | * | 11/1944 | Kiessling | 24/170 |
| 2,496,891 | A | * | 2/1950 | Preszler | 24/170 |
| 3,252,193 | A | * | 5/1966 | Matthews et al. | 24/170 |
| 3,328,856 | A | | 7/1967 | Jonas | |
| 4,897,888 | A | | 2/1990 | Broersma et al. | |
| 5,007,141 | A | * | 4/1991 | Gentes | 24/163 R |
| 5,012,533 | A | | 5/1991 | Raffler | |
| 5,077,839 | A | | 1/1992 | Keller | |
| D333,640 | S | | 3/1993 | Keller | |
| 5,469,583 | A | * | 11/1995 | Akeley et al. | 2/421 |
| 5,598,588 | A | * | 2/1997 | Lee | 2/421 |
| 5,608,918 | A | | 3/1997 | Salvaggio | |
| 5,666,700 | A | * | 9/1997 | Anscher et al. | 24/163 R |
| D414,401 | S | | 9/1999 | Aganian | |
| 6,108,875 | A | * | 8/2000 | Anscher | 24/198 |
| 6,560,825 | B2 | | 5/2003 | Maciejczyk | |
| 2003/0019080 | A1 | | 1/2003 | Anthony et al. | |
| 2003/0172499 | A1 | | 9/2003 | Uehara et al. | |

FOREIGN PATENT DOCUMENTS

| | | |
|---|---|---|
| EP | 0 772 983 | 5/1997 |

* cited by examiner

*Primary Examiner*—Rodney Lindsey
(74) *Attorney, Agent, or Firm*—Knobbe, Martens, Olson & Bear LLP

(57) ABSTRACT

A pair of strap adjustment assemblies for a bicycle helmet is provided. A first pair of straps is connected to one side of the helmet and a second pair of straps is connected to the other side of the helmet. A first strap adjustment assembly includes a release lever and a base for engaging the first pair of straps. The lever can be moved from a closed position to an open position. When the lever is in the open position, the user can move the strap adjustment assembly along the first pair of straps to adjust the location of the strap adjustment assembly. When the lever is in the closed position, the first strap adjustment assembly draws together the first pair of straps at a desired location. A second strap adjustment assembly is similar the first strap adjustment assembly and engages the second pair of straps, which are connected to the other side of the helmet.

16 Claims, 7 Drawing Sheets

STRAP ADJUSTMENT ASSEMBLY

RELATED APPLICATIONS

This application claims the priority benefit under 35 U.S.C. § 119(e) of the provisional application 60/567,356, filed Apr. 30, 2004, which is hereby incorporated by reference in its entirety.

FIELD OF THE INVENTION

The present invention relates to strap adjustment devices, and more specifically, to strap adjustment devices for use with straps of a helmet.

BACKGROUND OF THE INVENTION

Helmets for head protection during bicycle riding falls and accidents have become widely used by bicycle riders. Bicycle helmets can protect a rider from sustaining head injuries if the rider is involved in an accident (e.g., the rider falls). In fact, many states of the United States have laws requiring a person to wear helmets when riding a bicycle. For example, a child may be required by law to wear a bicycle helmet while riding their bicycle. Therefore, it is important that bicycle helmets are comfortable to wear so that people will want to wear the bike helmet.

Typical bike helmets have a protective shell which protects and surrounds the upper portion or crown of the wearer's head. The lower portion of the shell is typically disposed above the ears of the wearer and has an edge disposed along the forehead, sides, and back of the wearer's head. Helmet straps are coupled to opposite sides of the helmet and are used to hold the helmet on the wearer's head. Many times the helmet straps can be located in a position that is uncomfortable to the wearer. For example, the helmet straps may be positioned such that they contact and rub the wearer's ears.

SUMMARY OF THE INVENTION

A bicycle helmet for protecting a rider is described. The helmet comprises a shell configured to protect the head of a rider, a first pair of straps connected to a first side of the shell, a second pair of straps connected to a second side of the shell, and a pair of strap adjustment assemblies. The strap adjustment assemblies cooperate with the first pair of straps and the second pair of straps, respectively. Each member of the pair of strap adjustment assemblies comprises a base and a release lever. The base has a first face and a second face. The base defines a first pivot surface that defines an axis of rotation. The second face of the base defines a curved first guide surface and a curved second guide surface to one side of the axis of rotation and a third guide surface to the other side of the axis of rotation. The release lever has an arm section and a pivot section. The pivot section defines a second pivot surface. The release lever further includes a protuberance defining an engagement surface. The first pivot surface and the second pivot surface cooperate to permit manual manipulation of the arm section to rotate the lever about the axis between a first position wherein the engagement surface of the protuberance is unopposed and extends outward a first distance in the direction of the first face and a second position wherein the engagement surface of the protuberance extends less than the first distance in the direction of the first face. The base and the release lever define a first path for a first strap extending over the second face side of the first guide surface, over the first face side of the protuberance and over the second face side of the third guide surface, the base and the release member further define a second path for a second strap extending over the second face side of the second guide surface, over the first face side of the protuberance and over the second face side of the third guide surface.

In another embodiment, a helmet comprises a shell configured to protect the head of a rider, a first pair of straps that is connected to a first side of the shell, a second pair of straps that is connected to a second side of the shell, and a pair of strap adjustment assemblies. The strap adjustment assemblies cooperate with the first pair of straps and the second pair of straps, respectively. Each member of the pair of strap adjustment assemblies comprises a base and a release lever. The base has a first face and a second face. The base defines a first pivot surface that defines an axis of rotation. The second face of the base defines a first guide surface and a second guide surface to one side of the axis of rotation and a third guide surface to the other side of the axis of rotation. The release lever has an arm section and a pivot section. The pivot section defines a second pivot surface. The release lever further comprises a protuberance that defines an engagement surface. The first pivot surface and the second pivot surface cooperate to permit manual manipulation of the arm section to rotate the lever about the axis between a first position wherein the engagement surface of the protuberance extends outward a first distance in the direction of the first face and a second position wherein the engagement surface of the protuberance extends less than the first distance in the direction of the first face. The base and the release lever define a first path for a first strap extending over the second face side of the first guide surface, over the first face side of the protuberance and over the second face side of the third guide surface, the base and the release member further defines a second path for a second strap extending over the second face side of the second guide surface, over the first face side of the protuberance and over the second face side of the third guide surface. The portion of the base opposite the distal end of the release member is exposed to provide a secondary gripping surface to facilitate rotation of the release lever around the axis by squeezing the distal end of the release lever and the opposite portion of the base together with a finger and a thumb.

In another embodiment, a strap adjustment assembly for securing a pair of helmet straps comprises a base and a release member. The base has a first face and a second face. The base defines a first pivot surface that defines an axis of rotation. The second face of the base defines a first guide surface and a second guide surface to one side of the axis of rotation and a third guide surface to the other side of the axis of rotation. The release lever has an arm section and a pivot section. The pivot section defines a second pivot surface. The release lever further comprises a protuberance that defines an engagement surface. The first pivot surface and the second pivot surface cooperate to permit manual manipulation of the arm section to rotate the lever about the axis between a first position wherein the engagement surface of the protuberance extends outward a first distance in the direction of the first face and a second position wherein the engagement surface of the protuberance extends less than the first distance in the direction of the first face. The portion of the base opposite the distal end of the release member is exposed to provide a secondary gripping surface to facilitate rotation of the release lever around the axis by squeezing the distal end of the release lever and the opposite portion of the base together with a finger and thumb or two fingers. A portion of the first guide surface the second guide surface and the third guide surface are contained in a single plane and when the protuberance is in the first position, the engagement surface of the protuberance is accessible from a direction perpendicular to the plane.

BRIEF DESCRIPTION OF THE DRAWINGS

These and other features, aspects and advantages of the present strap adjustment assembly are described with reference to drawings of the preferred embodiments. These embodiments are intended to illustrate, but not to limit, the present invention. The drawings contain ten figures.

DETAILED DESCRIPTION OF THE PREFERRED EMBODIMENT

Figure 1:
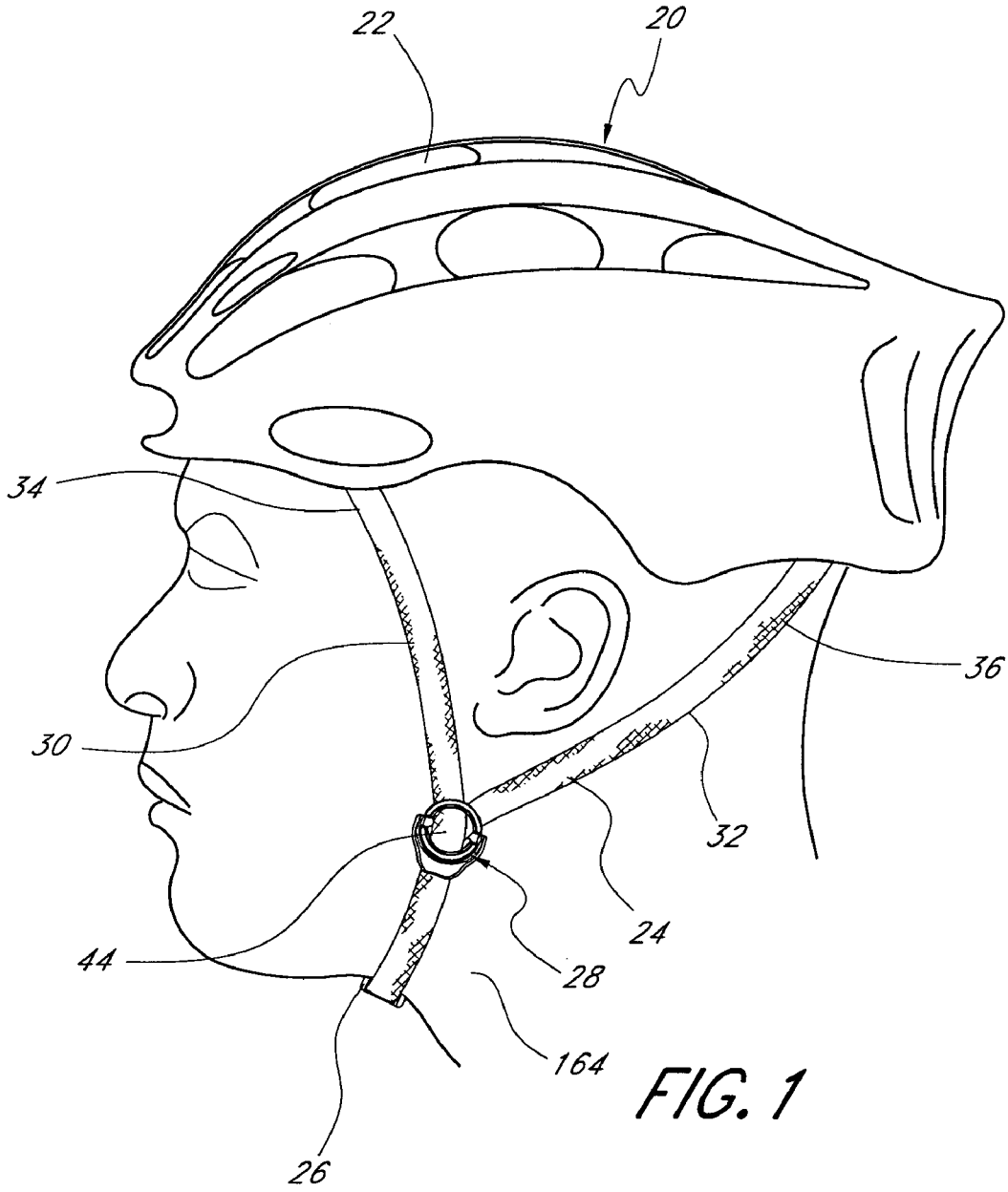
FIG. 1 is a side view of a wearer wearing a helmet including one embodiment of a strap adjustment assembly.

FIG. 1 is a side view of a person wearing a helmet including one embodiment of a strap adjustment assembly. The helmet 20 is designed to fit on the head of the rider and comprises a shell 22, a strap system 24, a buckle 26, and a pair of strap adjustment assemblies 28.

The shell 22 is a protective shell that is designed to protect the head of the rider. The shell 22 can be formed of rigid plastic and can have cushioning pads on its inner surface to achieve a comfortable fit.

The strap system 24 holds the shell 22 on the head of the wearer. In one embodiment, the strap system 24 includes two pairs of straps, each pair of straps is attached to one side of the helmet 20. In the illustrated embodiment, a pair of straps 30, 32 are coupled to one side of the helmet 20 and another pair of straps (not shown but preferably identical in structure) are coupled to the other side of the helmet 20. Preferably, the strap system 24 fixes the shell 22 to the wearer's head such that the shell does not slip.

In the illustrated embodiment, the straps 30, 32 have ends 34, 36, respectively, that are spaced apart and coupled to one side of the shell 22. The end 34 of the strap 30 can be coupled to the shell 22 and the other end of the strap 30 can be attached to the buckle 26. Similarly, the end 36 of the strap 32 can be coupled to the shell 22 and the other end of the strap 32 can be attached to the buckle 26. Although not illustrated, there can be a second pair of straps similar to the straps 30, 32 that are coupled to the opposite side of the shell 22 and the buckle 26 in a similar manner. The two pairs of straps can be looped around the chin of the user to snugly hold the helmet 20 on the wearer's head.

The straps can extend from the shell 22 and form a V-shaped web that is disposed on either side of each of the wearer's ears. Preferably, the straps 30, 32 converge such that the vertex of the web is located just below the wearer's ear, as shown in FIG. 1. The two pairs of straps can be threaded through the strap adjustment assembly 28 and surround at least a portion of the wearer's head. Because the ends 34, 36 are attached to the shell 22 at spaced apart locations (e.g., a front location and back location of the shell 22), the strap system 24 can securely hold the helmet 20 on the user's head.

The buckle 26 can be located at some point along the strap system 24 between the pair of strap adjustment assemblies. In the illustrated embodiment, the buckle 26 couples the ends of the two pairs of straps together to form a chin strap for holding the helmet 20 on the wearer's head. The buckle 26 can be readily opened so that the two pairs of straps can be separated, thereby allowing the helmet 20 to be conveniently removed from the wearer's head. The buckle 26 can be a clasp or other suitable device for fastening the ends of the pair of straps together.

Figure 3A:
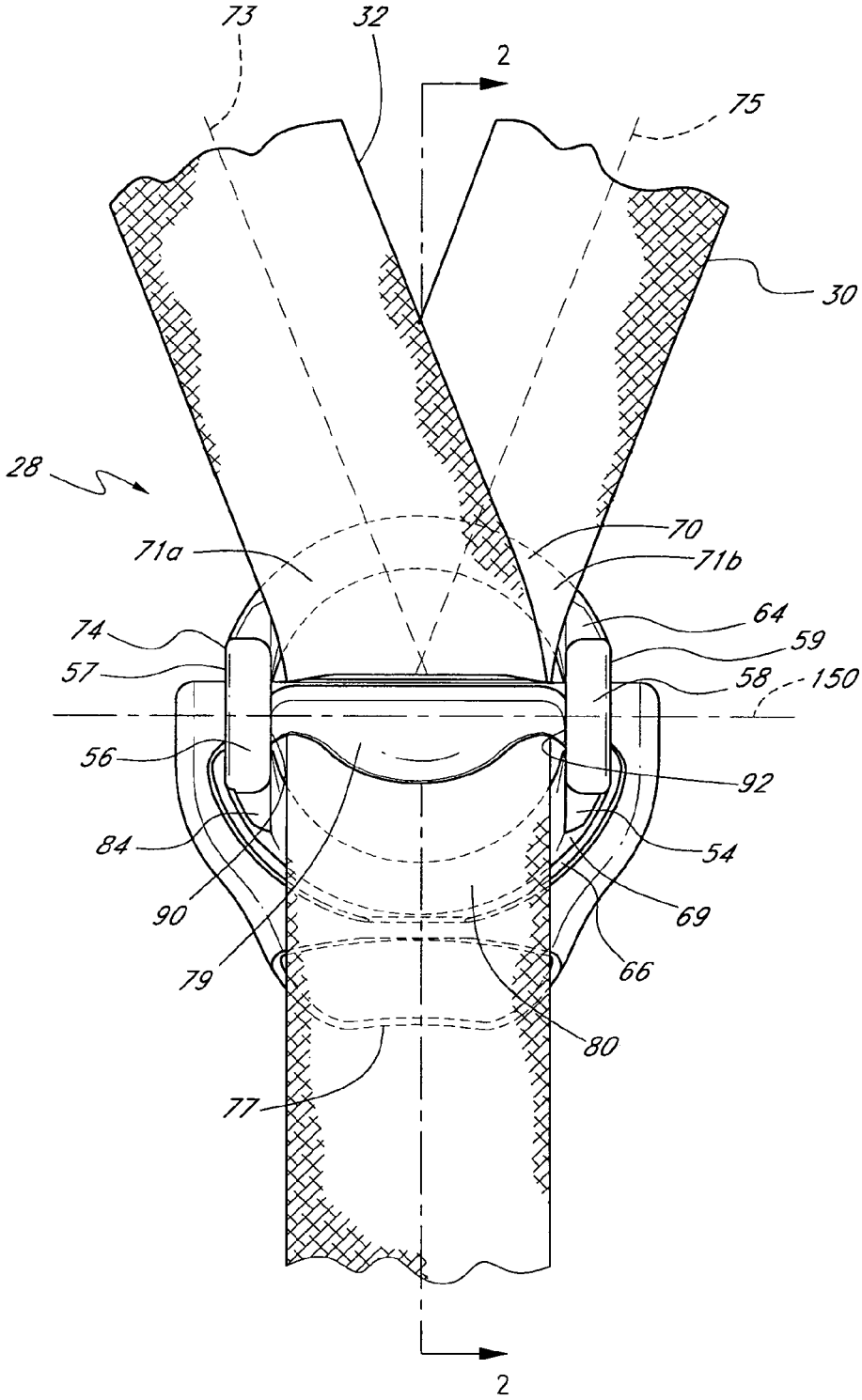
FIG. 3A is a bottom view of one embodiment of a strap adjustment assembly.
Figure 3B:
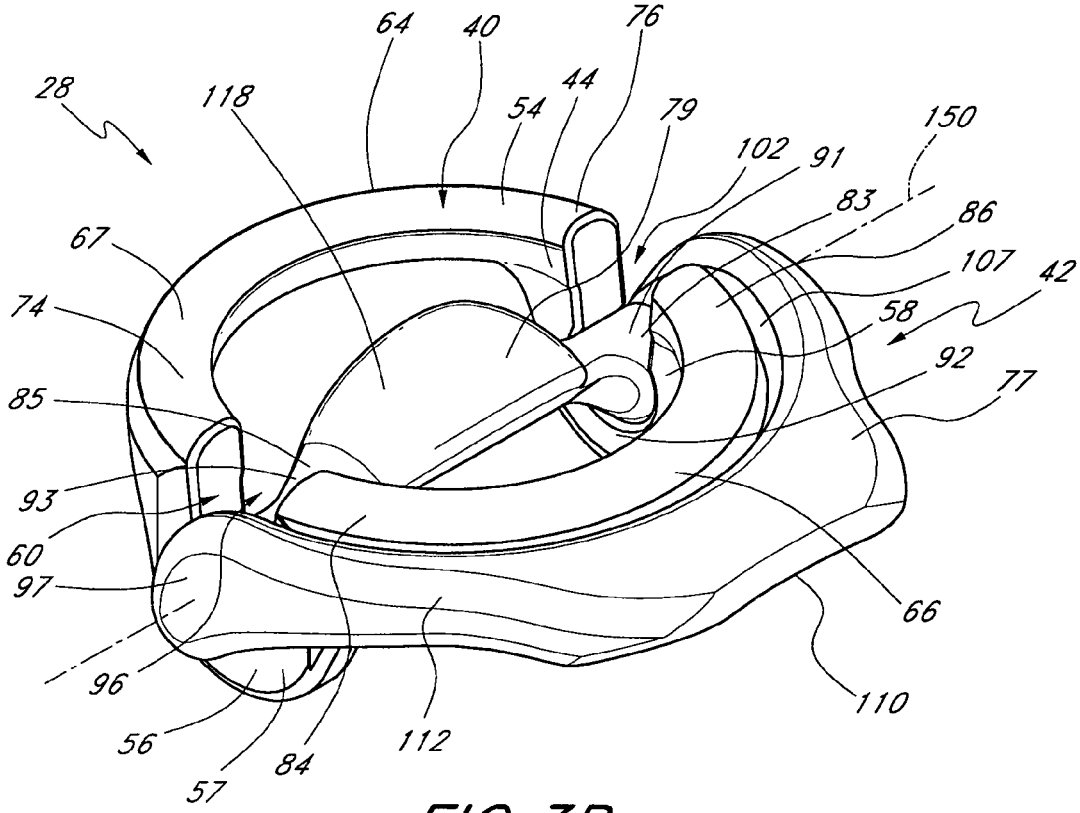
FIG. 3B is a perspective view of one embodiment of a strap adjustment assembly.

With respect to FIGS. 1 and 3B, the strap adjustment assembly 28 includes a base 40 and a release lever 42. The straps 30, 32 can be threaded between portions of the base 40 and the release lever 42 to preferably define the angular relationship between the straps 30, 32 (e.g., the V-shaped web shown in FIG. 1). For example, the strap adjustment assembly 28 can be moved towards the shell 22 of the helmet 20 so that the angle between the upper portions of the straps 30, 32 increases as the bottom of the V-shaped web moves towards the wearer's ear. The strap adjustment assembly 28 can be moved away from the shell 22 of the helmet 20 to reduce the angle between the straps 30, 32 and move the junction of the straps 30, 32 away from the wearer's ear. The wearer can adjust the position of the strap adjustment assembly 28 so that the straps 30, 32 are located in a comfortable position. For example, the straps 30, 32 may be in a comfortable position when they are spaced from the ear of the wearer, as shown in FIG. 1. Because people have different head shapes and sizes, the strap adjustment assembly 28 may be at different locations along the strap system 24 to achieve a desired fit for different people.

The base 40 and the release lever 42 are configured so that the release lever 42 is pivotally mounted to the base 40. The straps 30, 32 can be threaded between a portion of the base 40 and the release lever 42 exposing a portion of one of the straps 30, 32 through a window 44 of the base. In the illustrated embodiment, the window 44 is generally circular in shape but can have any suitable shape. For example, the window 44 can be elliptical or polygonal in shape.

Figure 2A:
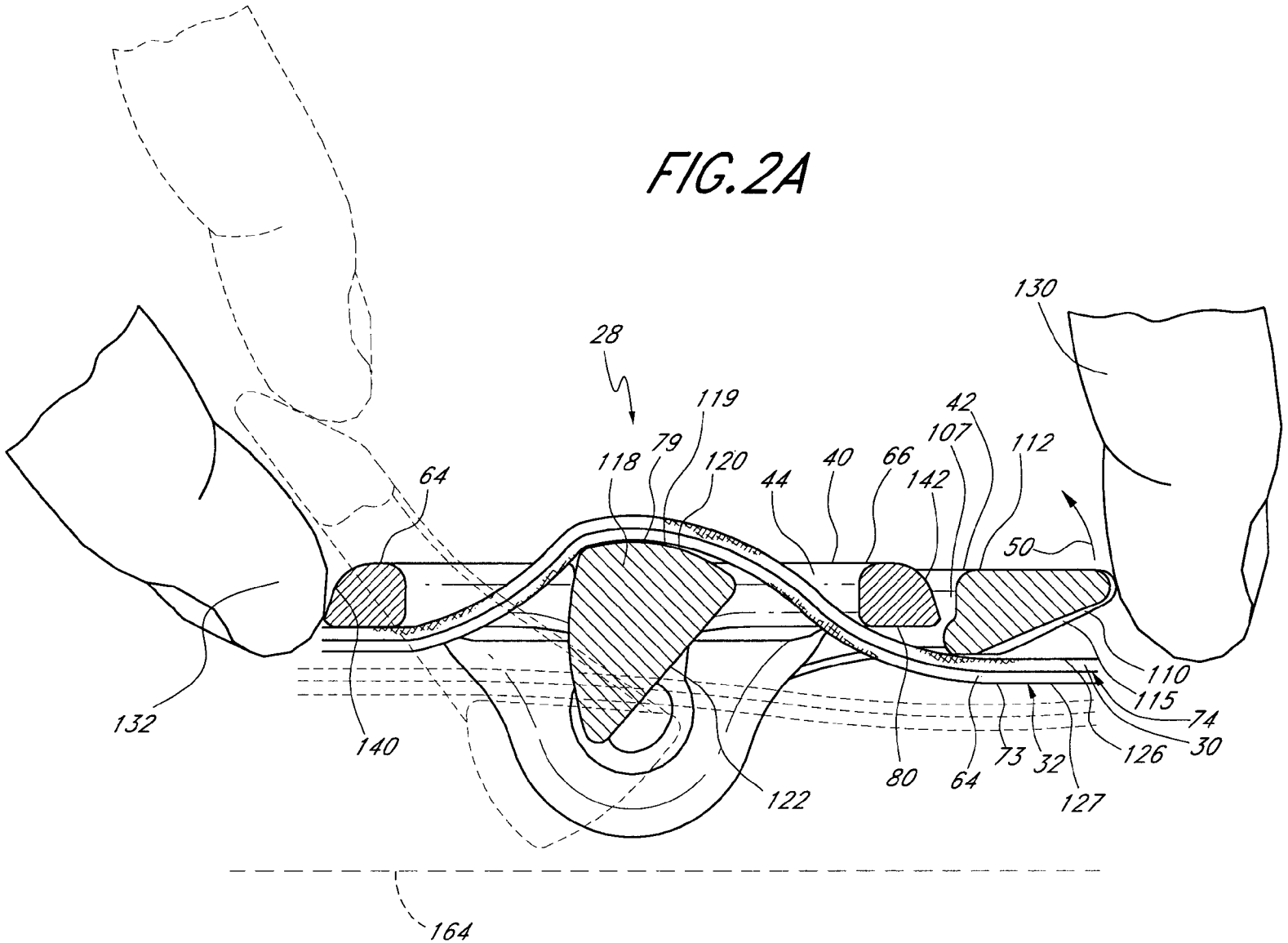
FIG. 2A is a cross-sectional view taken along line 2—2 of the strap adjustment assembly of FIG. 3*a*.
Figure 2B:
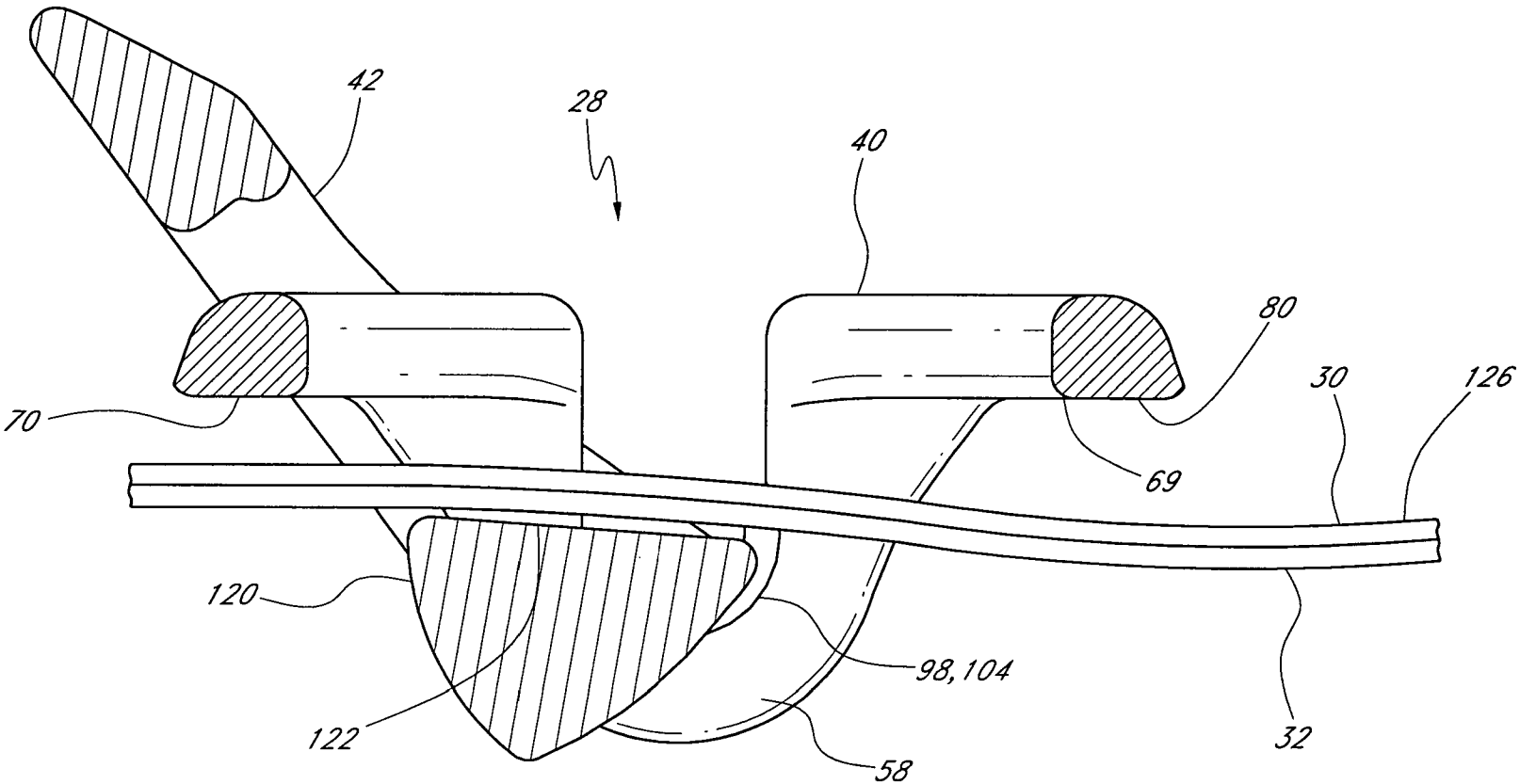
FIG. 2B is a cross-sectional view taken along line 2—2 of the strap adjustment assembly of FIG. 3*a* in a fully open position.

With respect to FIG. 1 through FIG. 2B, the release lever 42 can be manually manipulated between a closed position and an open position (shown in phantom in FIG. 2A). When the release lever 42 is in the closed position, the strap adjustment assembly 28 is preferably securely fastened to the pair of straps 30, 32. When the release lever 42 is in the open position, the strap adjustment assembly 28 can be slid along the pair of straps 30, 32. When the user has moved the open strap adjustment assembly 28 to a desired position, the release lever 42 can be manually manipulated from the open position to the closed position to secure the strap adjustment assembly 28 to the strap system 24. Preferably, the strap adjustment assembly 28 remains in substantially the same position along the strap system 24, even though the user wears the helmet 20 for an extended period of time.

In one non-limiting exemplary embodiment, the closed position and the fully opened position are separated by between 40 to 140 degrees about an axis of rotation 150 (FIGS. 3A and 3B). In another embodiment, the closed position and the open position are separated by between 100 to 170 degrees about the axis of rotation 150 (indicated by arrow 50). In another embodiment, the closed position and the open position are separated by between 120 to 160 degrees about the axis of rotation 150. The separation between the open position and the closed position can provide a desirable distance of travel of the release lever 42. For example, when the release lever 42 is in the closed position, the wearer of the helmet 20 can easily squeeze the release lever 42 along the arrow 50 towards the opposite side of the base 40 by using one of their fingers and their thumb.

FIG. 3A is a bottom view of one embodiment of the strap adjustment assembly 28. The release lever 42 includes a pivot section 79 and an arm section 77. The release lever 42 can be rotated about the axis of rotation 150. The pair of straps 30, 32 is disposed between portions of the base 40 and the pivot section 79 of the release lever 42.

Figure 4:
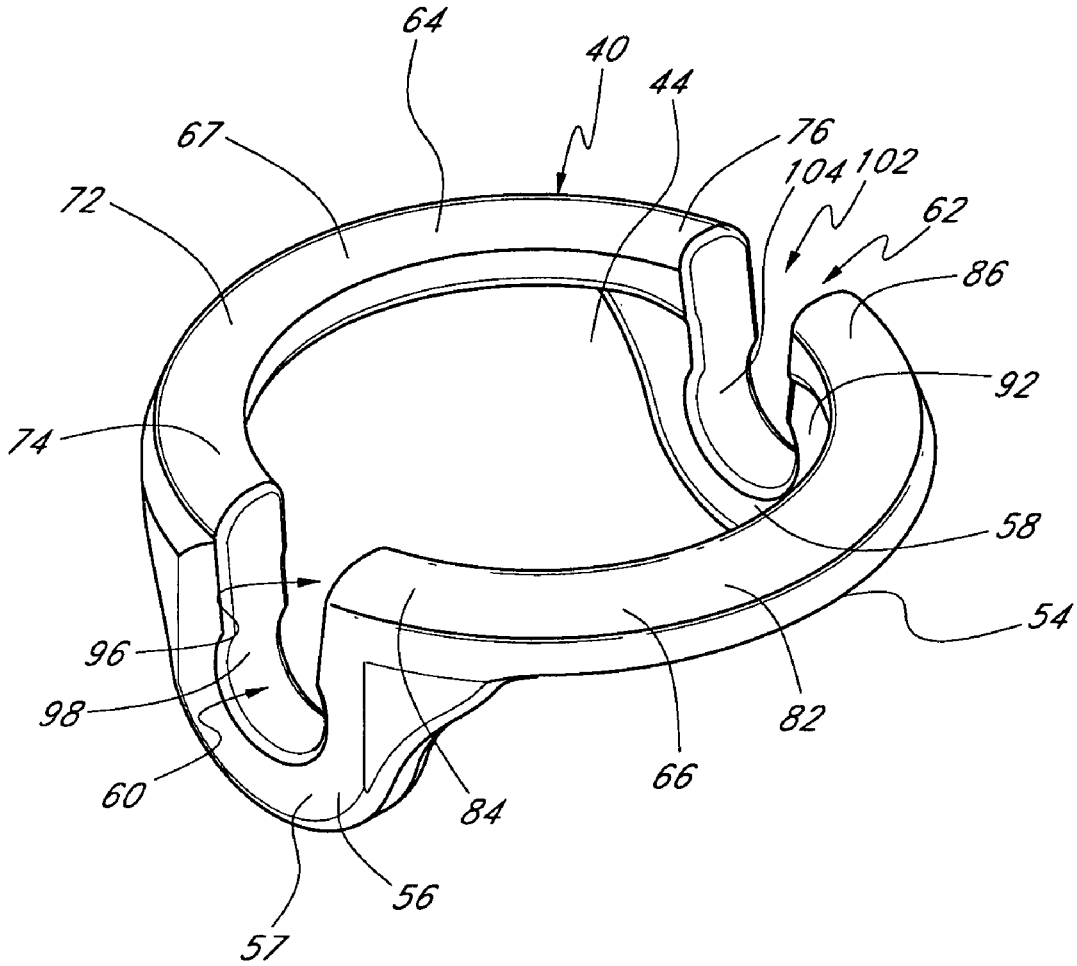
FIG. 4 is a perspective view of one embodiment of a base of a strap adjustment assembly.
Figure 5:
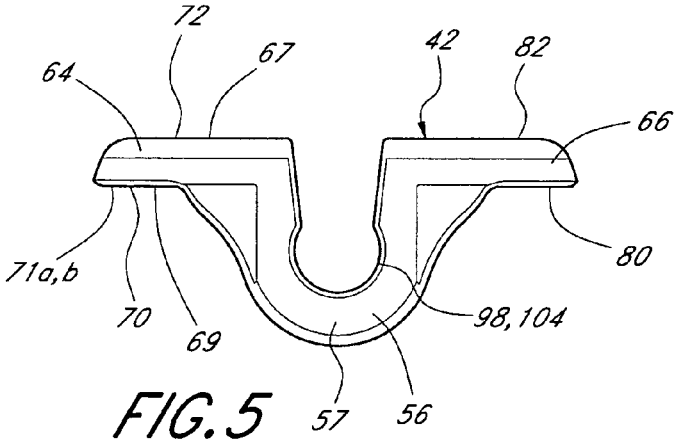
FIG. 5 is a side view of one embodiment of a base of a strap adjustment assembly.
Figure 6:
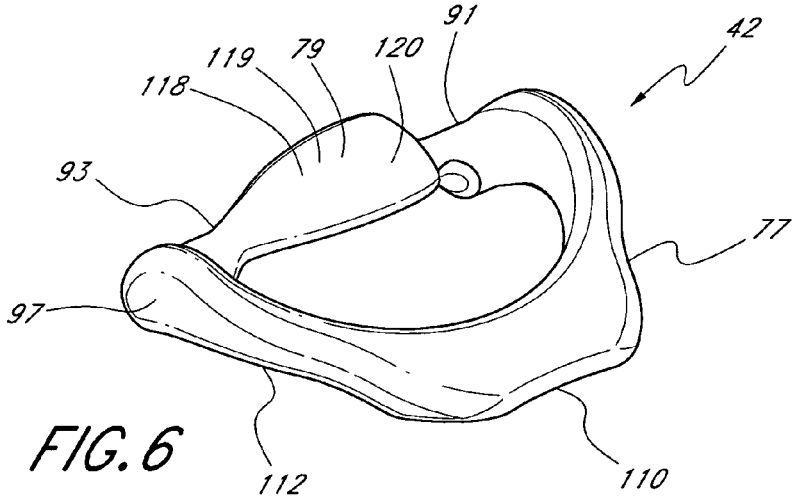
FIG. 6 is a perspective view of one embodiment of a release lever of a strap adjustment assembly.

With respect to FIG. 3B and FIG. 4, the base 40 includes a frame 54, a pair of sides 56, 58, and a pair of slots 60, 62 (FIG. 4). The frame 54 has a generally annular shape and can include a first guide member 64, a second guide member 66, an upper face 67, and a lower face 69 (FIG. 5). The pivot section 79 of the release lever 42 extends between the slots 60, 62 and is interposed between the first guide member 64 and the second guide member 66.

The first guide member 64 and second guide member 66 can cooperate to define the upper face 67 and the lower face 69. In one embodiment, the upper face 67 faces outwardly away from the wearer of the helmet and the lower face 69 faces towards the wearer. The size of the straps 30, 32 and the strap adjustment assembly 28 can be optimized to achieve the desired footprint or contact surface area between both the pair of straps 30, 32 and the strap adjustment assembly 28 and the wearer's skin 164. The strap adjustment assembly 28 can contact and slide against the wearer's skin 164 without causing appreciable discomfort of the wearer of the helmet 20. Additionally, in the illustrated embodiment of FIG. 2A, the sides 56, 58 provide smooth, curved surfaces that can contact the wearer's skin 164. Thus, the sides 56, 58, the straps 30, 32, and the lower face 69 can cooperate to ensure that the strap adjustment assembly 28 seats comfortably against the skin 164 of the wearer. Additionally, the upper face 67 and the lower face 69 can comprise surfaces of the base 40 and the release lever 42. For example, the lower face 69 can comprise the faces of the base 40 and the release lever 42 that face towards the wearer of the helmet.

The first guide member 64 is disposed on one side of the slots 60, 62 and the second guide member 66 is disposed on the other side of the slots 60, 62. In the illustrated embodiment, the first guide member 64 and the second guide member 66 are each curved members that cooperate to define the window 44. Preferably, the first guide member 64 and the second guide member 66 define opposing portions of the window 44, which is generally circular. However, the first guide member 64 and the second guide member 66 can have any suitable shape for permitting at least a portion of the pivot section 79 to extend through the window 44, preferably extending through the plane containing the upper face 67.

The first guide member 64 includes ends 74, 76 that are connected to the sides 56, 58, respectively. The guide member 66 includes ends 84, 86 that are connected to the sides 56, 58, respectively.

The sides 56, 58 are configured to receive portions of the release lever 42 such that the release lever 42 is pivotally mounted to the base 40. As shown in FIG. 3A, the sides 56, 58 can straddle the straps 30, 32 to provide exposed outwardly facing surfaces 57, 59, respectively, that can be conveniently gripped by user to move the strap adjustment assembly 28. The side 56 is connected to the end 74 of the first guide member 64 and the end 84 of the second guide member 66. The side 58 is connected to the end 76 of the first guide member 64 and the end 86 of the second guide member 66. In the illustrated embodiment, the sides 56, 58 are diametrically spaced and configured such that the straps 30, 32 can be interposed between the sides 56, 58. The sides 56, 58 may limit the rotational movement of the base 40 relative to the straps 30, 32. That is, the side 56 can have a surface 90 facing an opposing surface 92 of the side 58. The surfaces 90, 92 can contact and slidably engage the edges of the straps 30, 32, thereby limiting movement between the base 40 and the straps. Additionally, the sides 56, 58 can contact the skin 164 of the wear to prevent the pivot section 79 of the release lever 42 from contacting the skin 164 when the release lever 42 is in the fully opened position, partially opened position, and/or closed position. In the illustrated embodiment, the pivot section 79 of the release lever 42 does not touch the wearer when the release lever 42 is in the closed position.

With reference to FIGS. 3B and 4, the slots 60, 62 can surround one or more portions of the release lever 42. The slots 60, 62 can cooperate to define one or more pivot surfaces, each pivot surface can engage a portion of the pivot section 79 of the release lever 42. In the illustrated embodiment of FIG. 4, the slot 60 includes an opening 96 and a pivot surface 98. The opening 96 is interposed between the ends 74, 84 of the guide members 64, 66, respectively, and extends from the pivot surface 98 to the upper face 67. The opening 96 is configured and sized such that a portion of the pivot section 79 can be passed through the opening 96 and engage the pivot surface 98. The release lever 42 can be disengaged with the pivot surface 98 by passing the pivot section 79 of the release lever 42 through and out of the opening 96. The slot 62 includes an opening 102 and the pivot surface 104. The slot 62 is generally similar to the slot 60 and, therefore, will not be described in detail.

With respect to FIG. 4 and FIG. 5, the pivot surfaces 98, 104 are designed to rotatably hold the pivot section 79 of the release lever 42 as described above. The pivot surfaces 98, 104 can define the axis of rotation 150 (FIG. 3B) of the release lever 42. Preferably, the axis of rotation 150 is generally parallel to the longitudinal axis of the pivot section 79. The pivot surfaces 98, 104 can be smooth, curved surfaces that can slidably engage the pivot section 79 of the release lever 42. However, the pivot surfaces can have any other suitable shape for engaging at least a portion of the release lever 42.

The first guide member 64 includes a curved guide surface 70 and the upper surface 72. The second guide member 66 includes a guide surface 80 and the upper surface 82. The first guide member 64 is on one side of the axis of rotation 150 and the second guide member 66 is on the other side of the axis of rotation 150.

With respect to FIG. 3A, the curved guide surface 70 can be adapted to engage one or more surfaces of the straps 30, 32. The curved guide surface 70 can comprise a first guide surface 71*a* and a second guide surface 71*b*. Each of the guide surfaces 71*a*, 71*b* can contact one of the straps of the strap system 24. In the illustrated embodiment, the first guide surface 71*a* can slidably contact the strap 32, and the second guide surface 71*b* can slidably contact the strap 30. The first guide surface 71*a* is on one side of the first guide member 64 and the second guide surface 71*b* is on the other side of the first guide member 64.

The guide surface 80 of the guide member 66 can engage one of the straps 30, 32. As illustrated in FIG. 2A, for example, the strap 30 contacts the guide surface 80.

As shown in FIG. 5, a portion of the guide surfaces 71*a*, 71*b* of the first guide member 64 and a portion of the guide surface 80 of the second guide member 66 are generally contained in a single plane. Preferably, the pivot section 79 is accessible from a direction perpendicular that plane. The guide surfaces 71*a*, 71*b*, 80 can provide continuous edges that permit easy slidability of the straps 30, 32. In one embodiment, the guide surfaces 71*a*, 71*b*, 80 have generally smooth faces and edges. Advantageously, the straps 30, 32 can slide along the guide surfaces 71*a*, 71*b*, 80 with insignificant frictional interaction between those surfaces and the straps 30, 32. This may result in a strap adjustment assembly 28 that can be easily moved to a desired position, which, in turn, can determine the angular relationship between the straps 30, 32 as illustrated in FIGS. 1 and 3A. Modified embodiments of the strap adjustment assembly 28 can have surfaces 71*a*, 71*b*, 80 that are non-coplanar. Optionally, the curved guide surfaces 71*a*, 71*b*, 80 can be textured and/or have protrusions, spikes, or any other suitable structures for inhibiting movement of the strap adjustment assembly 28 when the release lever 42 is in the closed position.

In the illustrated embodiment of FIG. 3A, the guide surfaces 71*a*, 71*b*, 80 preferably have generally uniform widths along their length. However, the guide surfaces 71*a*, 71*b*, 80 can have a width that varies along their length. The guide members 64, 66 can have a generally U-shaped cross-section, as shown in FIG. 2A. However, the guide members 64, 66 can have any shaped cross-section suitable for providing the desired structural support to the strap adjustment assembly 28 and engaging the straps 30, 32. For example, the guide members 64, 66 can have a rectangular, circular, elliptical, or any other suitable cross-section for engaging with the straps 30, 32.

With continued reference to FIG. 3A, the base 40 and the release lever 42 can define one or more paths for the straps 30, 32 of the helmet 20. In one embodiment, the base 40 and the release lever 42 define a first path 73 and a second path 75. The strap 32 is disposed along the first path 73 and extends over the lower face 69 side of the first guide member 64, over the upper surface 67 side of the pivot section 79, and over the lower face 69 side of the second guide member 66. The strap 30 is disposed along the second path 75 and extends over the lower face 69 side of the first guide member 64, over the upper surface 67 side of the pivot section 79, and over the lower face 69 side of the second guide member 66. In the illustrated embodiment, for example, strap 32 extends over the guide surface 71*a*, over the upper surface 67 side of the protuberance 118, and over the guide surface 80. The strap 30 extends over the guide surface 71*b*, over the upper surface 67 side of the protuberance 118, and over the guide surface 80. As shown in FIGS. 1 and 3A, the portions of the straps 30, 32 on one side of the protuberance 118 define an acute angle to straddle the wearer's ear and the portions of the straps 30, 32 on the other side of the protuberance substantially fully overlap and are generally parallel to each other.

The base 40 can be made from material, such as metal or plastic, that can provide sufficient structural rigidity. For example, the base 40 can be constructed from other types of materials with suitable characteristics, such as composite materials. One of ordinary skill in the art can determine the appropriate combination of material type and configuration and shape of the base 40 to achieve the desired characteristics of the base 40. For example, the base 40 can be made from a lightweight but rigid material to reduce the weight of the helmet 20. In one embodiment, the base 40 may be a single piece of integrally molded plastic. Similarly, the release lever 42 may also be a single piece of integrally molded plastic. Preferably, the base 40 and the release lever 42 are formed through an injection molding process, which can result in high through-put, and thus decreases the cost of manufacturing the strap adjustment assemblies 28. It will be recognized that other materials or manufacturing processes as known in the art may also be used. It is contemplated that the base 40 and the release lever 42 can be made from similar or different materials. Additionally, the base 40 can be made of material that can slidably engage the release lever 42 without appreciable wear between the mated surfaces of the base 40 and the release lever 42.

With reference to FIG. 3B, the release lever 42 includes the arm section 77 and the pivot section 79. The arm section 77 is configured to surround at least a portion of the base 40. In the illustrated embodiment, the arm section 77 is a curved member and extends from the axis of rotation 150 and surrounds the second guide member 66. The arm section 77 is thus exposed making it easy for the wearer to quickly grasp the arm section 77. Thus, the location of the release lever 42 may facilitate gripping of the arm section 77 so that the wearer of the helmet 20 can conveniently position the release lever 42 in the open or closed position. As illustrated in FIG. 2A, the release lever 42 may be positioned so that a portion of the arm section 77 and a portion of the base 40 are contained in the same plane, resulting in a low profile strap adjustment assembly 28. The low profile of the strap adjustment assembly 28 can minimize the risk of the base 40 and/or the release lever 42 being accidentally caught or pulled. In some embodiments, the inner surface 107 engages the base 40 when the release lever 42 is in the closed position. The frictional interaction between the inner surface 107 and the base 40 can inhibit or prevent relative movement between the base 40 and the release lever 42. For example, the release lever 42 can be snapped into and out of the closed position. In other embodiments, the arm section 77 is sized such that its inner surface 107 is spaced from the upper face 67 of the base 40 in order to provide rotation of the release lever 42 about the axis of rotation 150 without having the release lever 42 contacting the base 40.

The arm section 77 can be designed so that a user can easily move it to achieve the open and the closed position. In the illustrated embodiment of FIG. 2A, the arm section 77 includes a tab 110 and a curved body 112. The tab 110 has a chamfered portion that forms a surface 115 at the distal end of the release lever 42. The tab 110 can be configured so that a user can position their thumb, or finger, on the surface 115 to pull or push the tab 110. That is, the surface 115 provides an exposed area that can be conveniently engaged by the thumb of the user. However, it is contemplated that the tab 110 can have any suitable shape and configuration to provide the user with a convenient structure for moving the release lever 42.

The body 112 of the arm section 77 can be a curved body that surrounds at least a portion of the base 40. In one embodiment, for example, the body 112 surrounds roughly about one half of the base 40 when the release lever 42 is in the closed position, as shown in FIGS. 3B. Thus, the strap adjustment assembly 28 has opposing, exposed surfaces on the base 40 and the release lever 42 that the user can grasp to move the strap adjustment assembly 28 between the open and the closed position, as discussed below.

Figure 7:
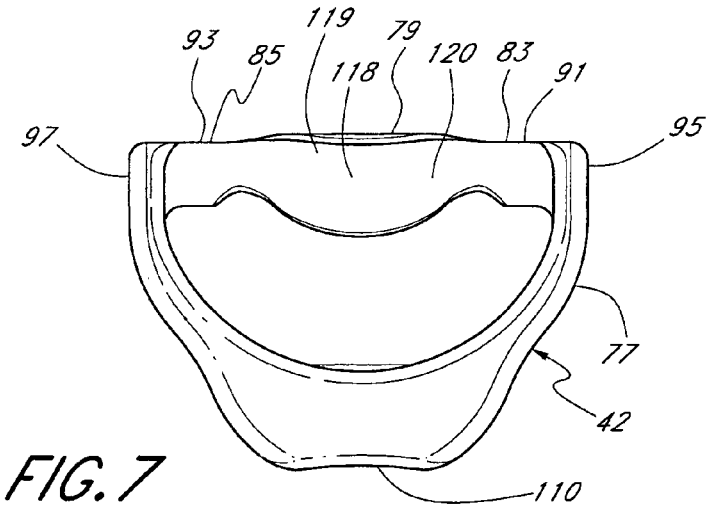
FIG. 7 is a top view of one embodiment of a release lever of a strap adjustment assembly.

With reference to FIG. 3B, the pivot section 79 includes end portions 91, 93 and outer surfaces 95, 97 (shown in FIG. 7). The end portions 91, 93 are rotatably engaged with the base 40 so that the release lever 42 is pivotally connected to the base 40. In one embodiment, the end portion 91 has a surface 83 that slidably engages the pivot surface 104 (FIG. 4). The end portion 93 has a surface 85 that slidably engages the pivot surface 98 (FIG. 4). When the release lever 42 is rotated about the axis of rotation 150, the surfaces 83, 85 slide against the surfaces 104, 98, respectively.

Each of the end portions 91, 93 is connected to one side of the arm 77. The end portions 91, 93 are configured to mate with the pivot surfaces 98, 104 of the base 40. Preferably, the end portions 91, 93 have a generally similar shape in cross-section as the pivot surfaces 98, 104 so that they are securely, rotatably held by the base 40. In the illustrated embodiment, the curved surfaces 85, 83 are generally cylindrical and configured to mate with the pivot surfaces 98, 104 that have a generally semi-circular profile (shown in FIG. 5). However, the end portions 91, 93 can have any suitably shaped surfaces for cooperating with the pivot surfaces 98, 104 of the base 40 for the desired movement between the base 40 and the release lever 42.

With reference to FIGS. 2A and 2B, the protuberance 118 includes an engagement surface 119 having a first surface 120 and a second surface 122 (shown in FIG. 2). The release lever 42 can be positioned so that the protuberance 118 is unopposed because there is not a cooperating surface directly opposite of the protuberance 118. That is, the straps 30, 32 are not sandwiched between directly opposing mated surfaces.

When the release lever 42 is in the closed position, the protuberance 118 extends a first distance in the direction of the upper face 67. For example, the distance between a portion of the first surface 120 and the axis of rotation 150 can be in the range of about 2 mm to about 7 mm. In another embodiment, the distance between the first surface 120 and the axis of rotation 150 can be in the range of about to about 3 mm to about 6 mm. The protuberance 118 can preferably extend through the plane passing through a portion of the lower face 69. More preferably, the protuberance 118 can extend through both a portion of the plane passing through the lower face 69 and the plane passing through a portion of the upper face 67. In the illustrated embodiment of FIG. 2A, the protuberance 118 is disposed through and extends out of the annular frame 54. In one embodiment, when the protuberance 118 is in the closed position, it extends out of the annular frame 54 a distance less than about 4 mm. In another embodiment, the protuberance 118 extends out of the annular frame 54 a distance less than about 2 mm. In yet another embodiment, the protuberance 118 extends out of the annular frame 54 a distance in the range of about 0.5 mm to about 3.5 mm. The release lever 42 can be located in another position so that the protuberance 118 extends a second distance, which is different than the first distance, in the direction of the upper face 67. In the illustrated embodiment, the protuberance 118 extends a first distance when the lever 42 is in the closed position. The protuberance 118 extends a second distance that is less than the first distance when the lever 42 is located in a partially, or fully, opened position. The second distance can be negative or positive.

The protuberance 118 is preferably configured such that the first surface 120 frictionally engages one of the straps 30, 32 and prevents relative movement between the strap adjustment assembly 28 and the straps 30, 32, when the release lever 42 is in the closed position, as illustrated in FIG. 2A. The surface 120 can have a surface treatment or texturing to inhibit, or prevent, sliding of the strap 32 along the surface 120. Preferably, at least a portion of the first surface 120 of the pivot section 79 can pass and extend from the window 44 of the base 40.

In one embodiment, the first surface 120 is convex and curved about the axis of rotation 150 providing an increased contact area between the first surface 120 and one of the straps 30, 32. However, the first surface 120 can be generally flat or have any other suitable shape for engaging with the straps of the helmet 20.

As shown in FIG. 2B, when the release lever 42 is in the open position, the protuberance 118 is configured such that the second surface 122 is generally parallel to the lower face 69 allowing for convenient sliding of the strap adjustment assembly 28. Preferably, the frictional force due to the interaction of the second surface 122 and the straps 30, 32 is insignificant. Optionally, the release lever 42 can be positioned such that the release lever 42 is adjacent to and surrounding a portion of the frame 40.

Figure 3C:
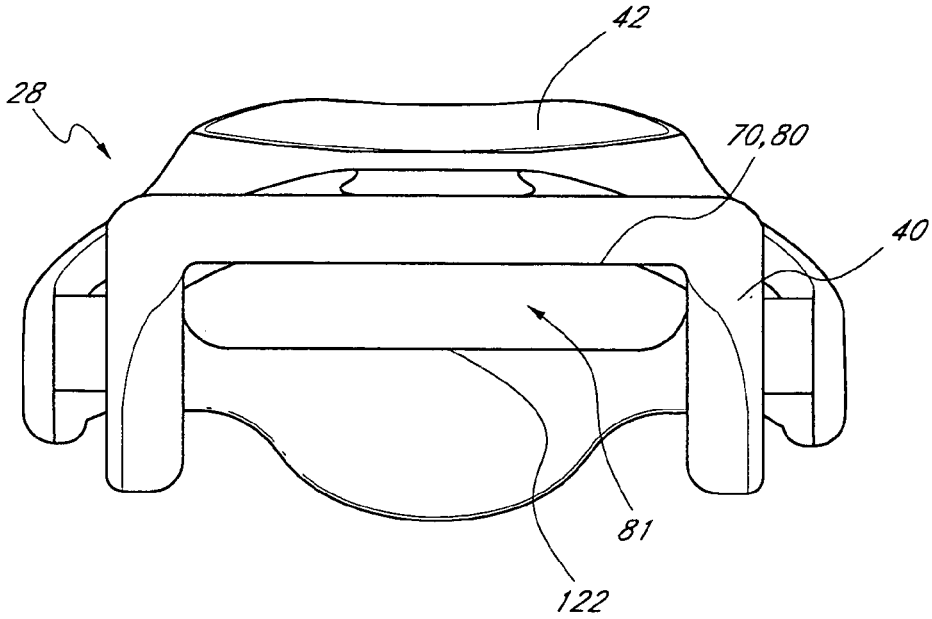
FIG. 3C is a front view of one embodiment of a strap adjustment assembly.

In the illustrated embodiment of FIG. 2B, when the release lever 42 is in the open position, the second surface 122 is generally flat and oriented such that the strap adjustment assembly 28 can slide along in the direction of the longitudinal axis of the straps 30, 32. As shown in FIG. 3*c*, the surface 122 can be spaced below the guide surfaces 70, 80 and cooperates with the guide surfaces 70, 80 to define an elongated slot 81. The slot 81 has a generally rectangular shape and is defined by the surface 122, the sides 56, 58, and the frame 54. The straps 30, 32 are slidably disposed in the slot 81. In one embodiment, the distance between the surface 122 and the guide surfaces 70, 80 is generally greater than the thickness of both straps 30, 32 combined, when the release lever 42 is in the opened position. Although not illustrated, the distance between the surface 122 and the guide surfaces 70, 80 can be generally equal to or less than the thickness of both the straps 30, 32 combined. The slot 81 can have any shape suitable for permitting the straps 30, 32 to slide relative to the strap adjustment assembly 28. It is contemplated that one of ordinary skill in the art can determine the appropriate angular relationship between the first surface 120 and the second surface 122 to achieve the desired open and closed position of the release lever 42.

The release lever 42 extends from the axis of rotation 150 past the first guide member 64 to facilitate easy engagement of the arm section 77 by the wearer in order to move the release lever 42. As shown in FIG. 2B, the wearer can easily grasp, or apply a force to, the exposed tab 110 of the release lever 42. Thus, the location of the release lever 42 can provide a convenient means of gripping of the release lever 42 and the base 40 in order to move the strap adjustment assembly 28 between the open and closed position.

In operation, the strap adjustment assembly 28 can be moved towards or away from the helmet 20 to change the location and angular relationship between the straps 30, 32. In the illustrated embodiment of FIG. 1, the strap adjustment assembly 28 is in a closed position so that the strap adjustment assembly 28 is securely fastened to the straps 30, 32. The strap adjustment assembly 28 brings the straps 30, 32 together so that the portions of the straps extending below the strap adjustment assembly 28 are on top of each other. The overlapped straps can then extend down and around the wearer's chin and their ends can be coupled to the buckle 26. The wearer may desire to have the straps 30, 32 spaced from their ear to prevent rubbing between the straps and their ear. When the strap adjustment assembly 28 is in the closed position, as shown in FIGS. 1 and 2A, the first guide member 64, second guide member 66, and the arm section 77 are on one side of the straps 30, 32 and the pivot section 79 is on the other side of the straps 30, 32.

In the illustrated embodiment of FIG. 2A, the strap 30 has an upper surface 126 that can contact at least a portion of the guide surface 80 of the second guide member 66 to provide friction between the base 40 and the strap 30. Similarly, the upper surface 126 of the strap 30 can contact the curved guide surface 70 of the first guide member 64 of the base 40 to provide frictional interaction. When the helmet 20 is worn by the rider, the straps 30, 32 can be biased toward the pivot section 79 to ensure frictional engagement between the straps and the pivot section 79. The interaction between the pivot section 79 and the straps 30, 32 causes the surface 126 of the strap 30 to remain in contact with at least a portion of the surfaces 70, 80. The surface 120 of the pivot section 79 frictionally engages the lower surface 127 of the strap 32. In other words, when the helmet 20 is worn by the user and the strap adjustment assembly 28 is in the closed position, the cooperation of the straps 30, 32 and the pivot section 79 can ensure frictional engagement between a portion of the straps and both the base 40 and the release lever 42.

To adjust the location of the helmet lock mechanism 28, the user can move the release lever 42 from the closed position to an open position while the helmet 20 is being worn. As shown in FIG. 2*a*, the user can place their thumb 130 (not to scale) on the release lever 42, preferably the tab 110, and their finger 132 (not to scale) on a surface 140 and can squeeze the tab 110 and the surface 140 together. The surface 140 is exposed in order to provide a convenient gripping surface to facilitate rotation of the release lever 42 about the axis of rotation 150. Additionally, the release lever 42 extends from the axis of rotation 150 past the second guide member 66 to facilitate gripping of the release lever 42, as discussed above. Thus, both the surface 140 and a portion of the release lever 42 are exposed and readily accessible so that a user can quickly and conveniently move the release lever 42 between the open position and the closed position.

When the release lever 42 is in the open position, the strap adjustment assembly 28 can be easily slid along the straps 30, 32. The wearer of the helmet can grip opposing outer portions of the strap adjustment assembly 28 in order to slide the assembly. For example, the wearer of the helmet can grip both the outwardly facing surface 57 of the side 56 and/or the outer surface 97 while also gripping both the outwardly facing surface 59 of the side 58 and/or the outer surface 95. The outer surfaces 95, 97 are gripping surfaces that can be conveniently grasped by the wearer. In the illustrated embodiment, the outer surfaces 95, 97 are located on opposing sides of the release lever 42. After the wearer has gripped the strap adjustment assembly 28, the wear can slide the strap adjustment assembly 28 to a desired location. Once the strap adjustment assembly 28 is in the desired position, the release lever 42 can be moved to the closed position. To close the strap adjustment assembly 28, the wearer of the helmet 20 can place their thumb 130 on the tab 110 and their finger 132 on a surface 142 of the second guide member 66 and can rotate the release lever 42 about the axis of rotation 150 until the release lever 42 reaches the closed position. When the strap adjustment assembly 28 is in the closed position, the strap adjustment assembly 28 is securely fastened to the straps 30, 32 which are preferably snugly held together.

Preferably, the pivot section 79 and the base 40 are configured so that the release lever 42 remains in the closed position. For example, when the release lever 42 is moved into the closed position, the interaction between the strap adjustment assembly 28 and the straps 30, 32 can maintain the release lever 42 in the closed position when the user wears the helmet 20. The user can pull the release lever 42 out of the closed position, and once the lever snaps out of place, it can be rotated about the axis of rotation 150. The release lever 42 can thus be conveniently snapped in and out of the closed position as desired.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A bicycle helmet, comprising:

a shell configured to protect the head of a rider;

a first pair of straps connected to a first side of the shell;

a second pair of straps connected to a second side of the shell;

a pair of strap adjustment assemblies cooperating with said first pair of straps and said second pair of straps, respectively, each member of said pair of strap adjustment assemblies comprising:

a base having a first face and a second face, said base defining an opening extending through said first face to a first pivot surface defining an axis of rotation, said second face of said base defining a curved first guide surface and a curved second guide surface to one side of said axis of rotation and a third guide surface to the other side of said axis of rotation; and a release lever having an arm section and a pivot section, said pivot section defining a second pivot surface and being configured to pass through said opening, said release lever further comprising a protuberance defining an engagement surface, said first pivot surface and said second pivot surface cooperating to permit manual manipulation of said arm section to rotate said lever about said axis between a first position wherein said engagement surface of said protuberance is unopposed and extends outward a first distance in the direction of said first face and a second position wherein said engagement surface of said protuberance extends less than said first distance in the direction of said first face, said base and said release lever defining a first path for a first strap extending over said second face side of said first guide surface, over said first face side of said protuberance and over said second face side of said third guide surface, said base and said release lever further defining a second path for a second strap extending over said second face side of said second guide surface, over said first face side of said protuberance and over said second face side of said third guide surface.

2. The bicycle helmet of claim 1, wherein a portion of said first guide surface, said second guide surface and said third guide surface are contained in a single plane.

3. The bicycle helmet of claim 2, wherein when said release lever is in said second position, said release lever extends from said axis of rotation past said third guide surface, to facilitate gripping of said release lever to move said release lever between said first position and said second position.

4. The bicycle helmet of claim 1, wherein said first position and said second position are separated by between 110 and 170 degrees about said axis of rotation.

5. The bicycle helmet of claim 1, wherein said base defines an annular member and said release lever surrounds roughly one half of said base when said release lever is in said second position.

6. The bicycle helmet of claim 1, wherein said protuberance is spaced below said first guide surface, said second guide surface, and said third guide surface when said release lever is in said second position so that the base and said protuberance define a slot configured to receive said first strap and said second strap.

7. The bicycle helmet of claim 6, wherein said spacing between said protuberance and said first guide surface, said second guide surface, and said third guide surface is generally equal to or greater than the combined thicknesses of said first strap and said second strap.

8. A helmet, comprising:

a shell configured to protect the head of a rider;

a first pair of straps connected to a first side of the shell;

a second pair of straps connected to a second side of the shell;

a pair of strap adjustment assemblies cooperating with said first pair of straps and said second pair of straps, respectively, each member of said pair of strap adjustment assemblies comprising:

a base having a first face and a second face, said base defining a first pivot surface defining an axis of rotation, said second face of said base defining a first guide surface and a second guide surface to one side of said axis of rotation and a third guide surface to the other side of said axis of rotation; and a release lever having an arm section and a pivot section, said pivot section defining a second pivot surface, said release lever farther comprising a protuberance defining an engagement surface, said first pivot surface and said second pivot surface cooperating to permit manual manipulation of said arm section to rotate said lever about said axis between a first position wherein said engagement surface of said protuberance extends outward a first distance in the direction of said first face and a second position wherein said engagement surface of said protuberance extends less than said first distance in the direction of said first face, said base and said release lever defining a first path for a first strap extending over said second face side of said first guide surface, over said first face side of said protuberance and over said second face side of said third guide surface, said base and said release lever further defining a second path for a second strap extending over said second face side of said second guide surface, over said first face side of said protuberance and over said second Lace side of said third guide surface; and wherein a central portion of the base opposite the distal end of the release lever is exposed when said helmet is worn to provide a secondary gripping surface to facilitate rotation of said release lever around said axis by squeezing said distal end of said release lever and said opposite portion of said base together with a finger and thumb.

9. The helmet of claim 8, the base of each of said strap adjustment assemblies further comprising a pair of opposing sides straddling one of said pairs of straps, each of the sides having an outwardly facing surface adapted for gripping by the wearer of the helmet for sliding the strap adjustment assembly along the straps after said release lever is located in the second position.

10. The helmet of claim 8, wherein a portion of said first guide surface, said second guide surface and said third guide surface are contained in a single plane and when said protuberance is in said first position, said engagement surface of said protuberance is accessible from a direction perpendicular to said plane.

11. The helmet of claim 10, wherein when said release lever is in said second position, said release lever extends from said axis of rotation past said third guide surface, to facilitate gripping of said release lever to move said release lever between said first position and said second position.

12. The helmet of claim 8, wherein said first position and said second position are separated by between 110 and 170 degrees about said axis of rotation.

13. The helmet of claim 8, wherein said base defines an annular member and said release lever surrounds roughly one half of said base when said release lever is in said second position.

14. A strap adjustment assembly for securing a pair of helmet straps, comprising;

a base having a first face and a second face, said base defining a first pivot surface defining an axis of rotation, said second face of said base defining a first guide surface and a second guide surface to one side of said axis of rotation and a third guide surface to the other side of said axis of rotation; and a release lever having an arm section and a pivot section, said pivot section defining a second pivot surface, said release lever further comprising a protuberance defining an engagement surface, said first pivot surface and said second pivot surface cooperating to permit manual manipulation of said arm section to rotate said lever about said axis between a first position wherein said engagement surface of said protuberance extends outward a first distance in the direction of said first face and a second position wherein said engagement surface of said protuberance extends less than said first distance in the direction of said first face, and wherein a central portion of the base opposite the distal end of the release lever is exposed when said helmet is worn to provide a secondary gripping surface to facilitate rotation of said release lever around said axis by squeezing said distal end of said release lever and said opposite portion of said base together with a finger and thumb or two fingers and wherein a portion of said first guide surface, said second guide surface and said third guide surface are contained in a single plane and when said protuberance is in said first position, said engagement surface of said protuberance is accessible from a direction perpendicular to said plane.

15. The strap adjustment assembly of claim 14, wherein a portion of said engagement surface of said protuberance is spaced below said first guide surface, said second guide surface, and said third guide surface and generally parallel to a portion of one of said first guide surface, said second guide surface, and said third guide surface when said release lever is in said second position, the portion of said engagement surface and said base define an elongated slot configured to receive a pair helmet straps.

16. The strap adjustment assembly of claim 15, wherein said elongated slot is generally rectangular and said spacing between the portion of said engagement surface of said protuberance and said first guide surface, said second guide surface, and said third guide surface is generally equal to or greater than the thickness of at least one of the straps of said pair of helmet straps.

* * * * *